US006224461B1

(12) United States Patent
Boehm, Jr. et al.

(10) Patent No.: US 6,224,461 B1
(45) **Date of Patent: *May 1, 2001**

(54) METHOD AND APPARATUS FOR STABILIZING THE PROCESS TEMPERATURE DURING CHEMICAL MECHANICAL POLISHING

(75) Inventors: Robert G. Boehm, Jr., Fremont; Anil K. Pant, Santa Clara; Wilbur C. Krusell, Palo Alto; Erik H. Engdahl, Livermore, all of CA (US)

(73) Assignee: Lam Research Corporation, Fremont, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,439

(22) Filed: Mar. 29, 1999

(51) Int. Cl.[7] ..... B24B 5/00

(52) U.S. Cl. ..... 451/7; 451/303; 451/307

(58) Field of Search ..... 451/7, 53, 296, 451/303, 307

(56) References Cited

U.S. PATENT DOCUMENTS

| | | | | |
|---|---|---|---|---|
| 4,438,598 | * | 3/1984 | Wohlmuth | 451/7 X |
| 4,450,652 | | 5/1984 | Walsh . | |
| 5,329,732 | | 7/1994 | Karlsrud et al. . | |
| 5,536,202 | * | 7/1996 | Appel et al. | 451/287 X |
| 5,558,568 | | 9/1996 | Talieh et al. . | |
| 5,632,667 | * | 5/1997 | Earl et al. | 451/41 |
| 5,643,060 | * | 7/1997 | Sandhu et al. | 451/7 X |
| 5,692,947 | | 12/1997 | Talieh et al. . | |
| 5,722,877 | * | 3/1998 | Meyer et al. | 451/303 X |
| 5,762,536 | | 6/1998 | Pant et al. . | |
| 5,762,537 | | 6/1998 | Sandhu et al. . | |
| 5,800,248 | | 9/1998 | Pant et al. . | |
| 5,851,135 | | 12/1998 | Sandhu et al. . | |
| 5,957,750 | * | 9/1999 | Brunelli | 451/7 |
| 5,961,372 | * | 10/1999 | Shendon | 451/307 X |
| 6,000,997 | | 12/1999 | Kao et al. . | |

FOREIGN PATENT DOCUMENTS

WO 98/35785 8/1998 (WO) .

OTHER PUBLICATIONS

Copy of Search Report for Corresponding to PCT Application PCT/US00/07453 dated Aug. 8, 2000.

* cited by examiner

*Primary Examiner*—David A. Scherbel
*Assistant Examiner*—Anthony Ojini
(74) *Attorney, Agent, or Firm*—Brinks Hofer Gilson & Lione

(57) ABSTRACT

A temperature compensating unit is coupled to a linearly moving belt of a polisher for adjusting the temperature of the belt, which temperature is measured by a sensor situated proximal to the belt.

22 Claims, 6 Drawing Sheets

METHOD AND APPARATUS FOR STABILIZING THE PROCESS TEMPERATURE DURING CHEMICAL MECHANICAL POLISHING

BACKGROUND OF THE INVENTION

1. Field of the Invention

The present invention relates to the field of semiconductor wafer processing and, more particularly, to controlling polishing temperature when performing chemical mechanical polishing on a linear planarization tool.

2. Background of the Related Art

The manufacture of an integrated circuit (IC) device requires the formation of various layers above a base semiconductor substrate, in order to form embedded structures over or in previous layers formed on the substrate. During the manufacturing process, certain portions of these layers need complete or partial removal to achieve the desired device structure. With diminishing feature size, such structures result in highly irregular surface topography causing manufacturing problems in the formation of thin film layers. To facilitate manufacturing processes, the rough surface topography has to be smoothened or planarized.

One of the methods for achieving planarization of the surface is chemical mechanical polishing (CMP). CMP is being extensively pursued to planarize a surface of a semiconductor wafer, such as a silicon wafer, at various stages of integrated circuit processing. CMP is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer, in combination with the chemical reaction of the slurry disposed between the wafer and the pad, provide the abrasive force with chemical erosion to planarize the exposed surface of the wafer (typically, a layer formed on the wafer). Typically, a downforce presses the wafer onto the pad to perform the CMP. In the most common method of performing CMP, a substrate is mounted on a polishing head and rotated against a polishing pad placed on a rotating table. The mechanical force for polishing is derived from the rotating table speed and the downward force on the head. The chemical slurry is constantly transferred under the polishing head. Rotation of the polishing head helps in the slurry delivery, as well as in averaging the polishing rates across the substrate surface.

Another technique for performing CMP to obtain a more effective polishing rate is using a linear planarization technology. Instead of a rotating pad, a moving belt is used to linearly move the pad across the wafer surface. The wafer is still rotated for averaging out the local variations, but the planarization uniformity is improved over CMP tools using rotating pads, partly due to the elimination of unequal radial velocities. In some instances, a fluid support (or platen) can be placed under the belt for use in adjusting the pad pressure being exerted on the wafer.

When a linear planarization tool is utilized, heat is generated by a variety of sources. At the pad surface where the pad engages the wafer, two factors contribute to heat generation. Heat is generated from the mechanical work, mostly the friction of the pad engaging the wafer. Heat is also generated from the exothermic chemical reaction of the slurry as CMP is performed. Transport of the heat energy away from the polishing tool is normally by natural convection to the ambient atmosphere or convection by the slurry as it is drained away from the pad. The remaining heat energy is stored in the tool, which will cause the tool temperature to rise.

The more critical temperature rise is noted in the polishing belt, as well as the pad material residing on the belt. Accordingly, a tool will experience a polish cycle to cycle global temperature rise as each subsequent wafer is polished on the tool. The temperature rise continues until an equilibrium temperature is reached. That is, when one wafer is processed immediately after another (without significant lag time between wafers), the belt temperature will rise, until some equilibrium temperature is reached. During this rise in temperature, it is appreciated that the polishing parameter or profile may vary from one wafer to the next as CMP is performed.

Once equilibrium temperature is reached, fairly consistent wafer polishing profile can be achieved, since the process temperature is stabilized. It should be noted that a significant number of wafers may need to be processed before this point is reached. FIG. 1 shows one experimental set of measurements. The graph of FIG. 1. shows temperature versus polishing time for a series of eight wafers polished one after the other. As can be seen from the intra-polish temperature profile of successive copper polish cycles overlaid on the graph, eight wafer polish cycles are required before the equilibrium temperature is reached. Since the first seven wafers were polished at less than the equilibrium operating temperature, the polishing profiles will vary due to the deviation in the process temperature of the wafer. The process temperature being the belt temperature (or at least very close to it). Therefore, some or all of these wafers may not be polished within the acceptable polishing tolerance, in which case the wafers may need rework or, worse, the wafers are scrapped. Scrapping 200 mm or 300 mm wafers is not very cost effective. At the least, repeatability of wafer polishing characteristic may not be achieved until the equilibrium temperature is reached.

Accordingly, it would be desirable to have a technique that provides for a more uniform cycle to cycle temperature repeatability when performing CMP.

SUMMARY OF THE INVENTION

The present invention describes a technique for controlling polishing temperature when polishing a planar surface. A belt, having a pad material residing thereon for polishing the planar surface, is disposed to move in a linear direction. A sensor is coupled to measure the temperature of the belt. A temperature compensating unit is coupled to the belt for adjusting the temperature of the belt to a selected operating temperature when polishing the planar surface.

DETAILED DESCRIPTION OF THE PREFERRED EMBODIMENTS

A scheme for controlling belt temperature during chemical mechanical polishing (CMP) when planarizing a wafer surface is described. In the following description, numerous specific details are set forth, such as specific structures, materials, polishing techniques, etc., in order to provide a thorough understanding of the present invention. However, it will be appreciated by one skilled in the art that the present invention may be practiced without these specific details. In other instances, well known techniques, structures and processes have not been described in detail in order not to obscure the present invention. Furthermore, although the present invention is described in reference to performing CMP on a layer formed on a semiconductor wafer, the invention can be readily adapted to polish other materials as well, such as glass, metal substrates or other semiconductor substrates, including substrates for use in manufacturing flat panel displays.

Figure 2:
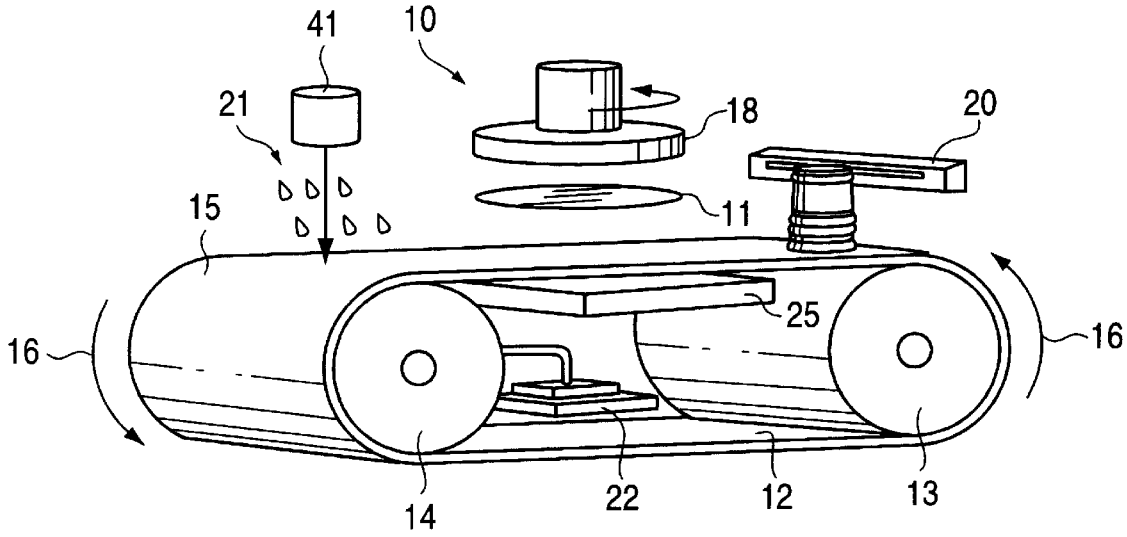
FIG. 2 is a pictorial illustration of a linear polisher which incorporates the temperature compensating technique of the present invention.

Referring to FIG. 2, a linear polisher 10 for use in practicing the present invention is shown. The linear polisher (also referred to as a linear planarization tool) 10 is utilized in planarizing a semiconductor wafer 11, such as a silicon wafer. Although CMP can be utilized to polish a base substrate, typically CMP is utilized to remove a material layer (such as a film layer) or a portion of the material layer deposited on the semiconductor wafer. Thus, the material being removed can be the substrate material of the wafer itself or one of the layers formed on the substrate. Formed layers include dielectric materials (such as silicon dioxide), metals (such as aluminum, copper or tungsten) and alloys, or semiconductor materials (such as silicon or polysilicon).

More specifically for IC fabrication, CMP is employed to planarize one or more of these layers fabricated on the wafer or is employed to expose an underlying topography while planarizing the surface. In many instances, CMP involves patterned features formed on the surface of a wafer. For example, a dielectric layer (such as silicon dioxide) may be deposited over the surface, covering both raised features, as well as the underlying dielectric layer. Then, CMP is used to planarize the overlying silicon dioxide, so that the surface is substantially planarized. It is desirable to stop the polishing process at a point the raised features are exposed.

In another technique, dual damascene structures are fabricated by the use of CMP. For example, via and contact trench openings are patterned and formed in an inter-level dielectric (ILD) layer residing on a semiconductor wafer. Subsequently, a metal, such as copper or aluminum, is deposited to fill in the via and trench openings. In the case of copper, a barrier layer (such as TiN, Ta, TaN, etc) is deposited into the openings first to operate as a barrier liner between the Cu and the ILD. Then, CMP is used to polish away the excess metal material residing over the ILD, so that the metal resides only in the via and trench openings. CMP allows for the surface of the contact region (upper portion of the dual opening) to have a substantially planar surface, while the metal above the surface of the ILD is removed. The formation and fabrication of dual damascene structures are known in the art.

Thus, CMP is utilized extensively to planarize film layers or formed features in which the planarization process is terminated at a particular point. In the dual damascene structure described above, the CMP is terminated when the metal is removed to expose the ILD. CMP ensures that the resultant structure has metal remaining only in the openings and that the upper surface of the ILD and the trench fill have a substantially planar surface. As noted, the art of performing CMP to polish away all or a portion of a layer formed on a wafer is known in the art.

The linear polisher 10 of FIG. 2 employs a linear planarization technology described above. The linear polisher 10 utilizes a belt 12, which moves linearly with respect to the surface of the wafer 11. The belt 12 is a continuous belt rotating about rollers (or spindles) 13 and 14, in which one roller or both is/are driven by a driving means, such as a motor, so that the rotational motion of the rollers 13, 14 causes the belt 12 to be driven in a linear motion (as shown by arrow 16) with respect to the wafer 11. The belt 12 is typically made from a strong tensile material. A polishing pad 15 is affixed onto the belt 12 at its outer surface facing the wafer 11. The pad can be made from a variety of materials, but is generally fibrous to provide an abrasive property. In some instances, the pad 15 and the belt 12 may be integrated as a single unit when fabricated. However constructed, the belt/pad assembly is made to move in a linear direction to polish (or planarize) the wafer 11.

The wafer 11 typically resides within a wafer carrier 18, which is part of a polishing head. The wafer 11 is held in position by a mechanical retaining means, such as a retainer ring, and/or by the use of vacuum. Generally, the wafer 11 is rotated, while the belt/pad assembly moves in a linear direction 16. A downforce is exerted to press the polishing head and carrier 18 downward, in order to engage the wafer onto the pad with some amount of force. The linear polisher 10 also dispenses a slurry 21 onto the pad 15. A variety of dispensing devices and techniques are known in the art for dispensing the slurry 21. A pad conditioner 20 is typically used in order to recondition the pad surface during use. Techniques for reconditioning the pad 15 generally require a constant scratching of the pad, in order to introduce roughness on the pad surface for slurry transport to the wafer surface and for removal of the residue build-up caused by the used slurry and removed waste material.

A support, platen or bearing 25 is disposed on the underside of belt 12 and opposite from the wafer 11, such that the belt/pad assembly resides between the bearing 25 and wafer 11. A purpose of bearing 25 is to provide a supporting platform on the underside of the belt 12 to ensure that the pad 15 makes sufficient contact with the wafer 11 for uniform polishing. Since the belt 12 will depress when the wafer is pressed downward onto the pad 15, bearing 25 provides a necessary counteracting support to this downforce.

The bearing 25 can be a solid platform or it can be a fluid bearing (also referred to as a fluid platen or support). In the practice of the present invention, the preference is to have a fluid bearing, so that the fluid flow from the bearing 25 can be used to control forces exerted onto the underside of the belt 12. The fluid is generally air or liquid, although a neutral gas (such as nitrogen) can be used. By such fluid flow control, pressure variations exerted by the pad on the wafer can be adjusted to provide a more uniform polishing profile across the face of the wafer 11. One example of a fluid bearing is disclosed in U.S. Pat. No. 5,558,568. Another example is described in U.S. Pat. No. 5,800,248.

Located opposite the bearing 25 and facing the underside of the belt 12 is a temperature compensating unit 22. It is appreciated that the temperature compensating unit 22 can be located at a variety of places, but the particular location shown is utilized since there is ample space where the underside of the belt is exposed.

When the linear planarization tool is utilized, heat is generated by the mechanical work and the exothermic chemical reaction of the slurry. As the polish temperature rises, the increase is noted in the temperature of the belt 12, which includes the pad material residing on the belt. Transport of the heat energy away from the polishing tool by natural convection and slurry disposal also increases as the belt temperature increase. The heat energy transport can be quantified by a convection equation applied to the belt. The convection equation is as follows:

$$Q=H_{belt}\,A_{surface}\,(T_{belt}-T_{ambient})$$

where,

Q is the convection of heat energy per unit time;

$H_{belt}$ is the convection coefficient as defined by the system for convecting heat from the system;

$A_{surface}$ is the surface area of the belt exposed to the ambient air;

$T_{belt}$ is the bulk temperature of the belt; and $T_{ambient}$ is the temperature of the ambient air.

Accordingly, at some belt temperature, the energy leaving the system will be in equilibrium with the energy added to the system by the CMP process. It is at this equilibrium point that the rise of the belt's overall (global) temperature no longer continues to increase and stability is achieved.

Figure 1:
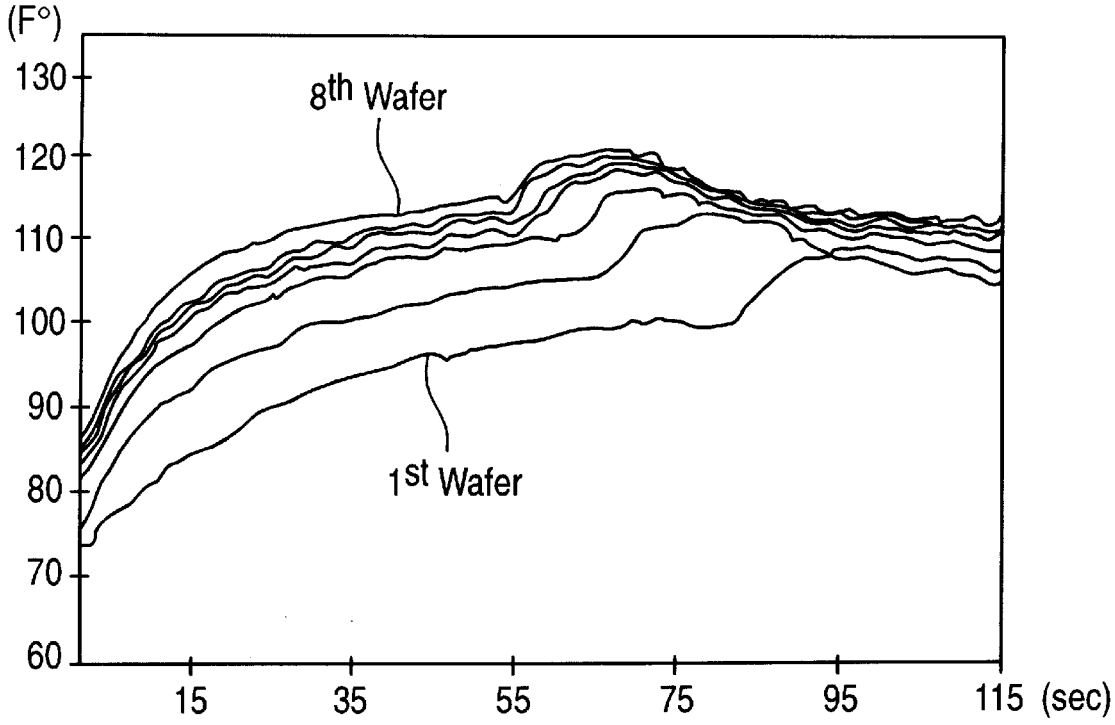
FIG. 1 (Prior Art)
FIG. 1 is a graphical illustration of belt centerline temperature versus polishing time for a prior art practice of sequencing through eight wafer cycles before the belt's equilibrium temperature is approached.

Thus, as CMP is commenced on the linear polisher 10, the first wafer will be processed at a belt temperature which is substantially below the equilibrium temperature. Each subsequent wafer polish increases the belt temperature, until sufficient number of wafers are polished to bring the belt temperature up to the equilibrium temperature. This deviation in the belt temperature was noted in FIG. 1. A sizeable disparity in the belt temperature is noted between the first wafer and the eighth wafer processed in FIG. 1. As was explained previously, this disparity in the process temperature at the wafer surface can result in significant variations in the polishing characteristics of the wafers. Thus, polishing repeatability suffers until the equilibrium temperature is reached.

It is to be noted that even after reaching the equilibrium temperature, any appreciable delay in the wafer processing cycle from one wafer to the next will result in the heat energy being transported away from the belt so that the belt temperature will decline from the equilibrium temperature. Therefore, once reaching the equilibrium temperature, the wafer processing cycle must continue at an adequate rate to ensure that the equilibrium temperature for the belt is maintained.

Figure 3:
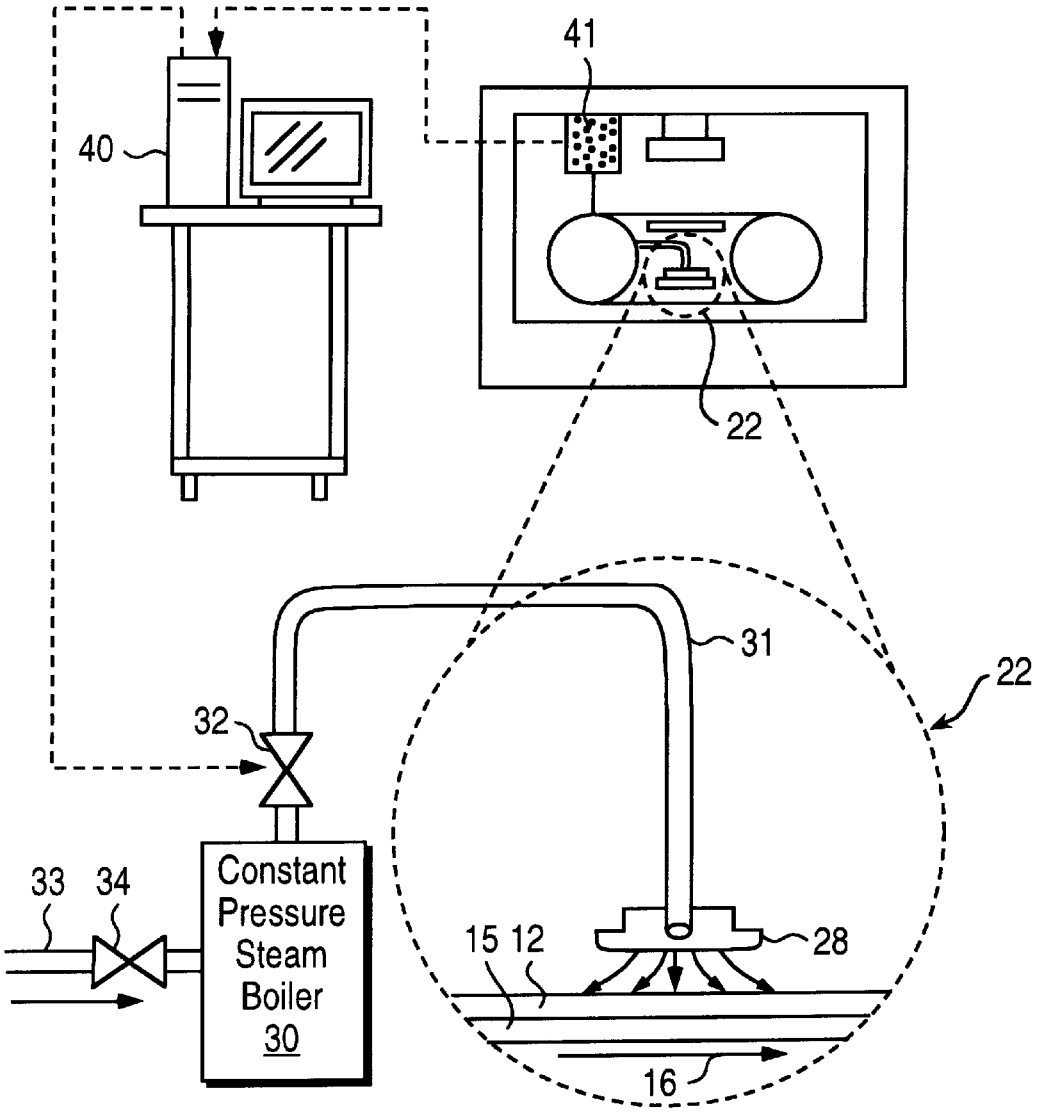
FIG. 3 is a cross-sectional drawing showing the linear polisher of FIG. 2 and an enlarged view of a section containing a temperature compensating unit of the present invention for adding heat energy to raise the belt temperature.

In order to alleviate the belt temperature deviation, the linear polisher 10 of the present invention utilizes the temperature compensating unit 22. FIG. 3 shows a cross-sectional view of the polisher 10 and an enlarged view of the belt section adjacent to a heat manifold 28, which is part of the temperature compensating unit 22. It is appreciated that the temperature compensating unit can take a variety of forms. One embodiment is shown in FIG. 3.

The particular unit 22 is comprised of a heat manifold 28 which is mounted proximal to the underside of the belt along the lower return path of the belt. The manifold 28 can be mounted by different means, such as by brackets or support housings. Furthermore, the manifold 28 is coupled to a steam boiler 30 by line 31. The boiler 30 is a constant pressure steam boiler, so that steam under a preselected pressure is fed from boiler 30 to the manifold 28 by line 31. A valve 32 regulates the steam being fed to the manifold 28. A water line 33 is coupled to the boiler 30 to feed water to the boiler 30. A valve 34 is used to regulate the water flow into the boiler 30. It is to be noted that the boiler 30 can be located in the polishing tool or at some distance from the tool.

A processor 40, shown as a computer in the example, is used to control the operation of the valve 32. A sensor 41 is disposed proximal to the belt 12 to measure the belt temperature. In the particular example, sensor 41 is mounted above the belt assembly adjacent to the polishing head assembly. The sensor 41 can be of a variety of sensors for monitoring heat or temperature. In the shown embodiment, an infrared thermometer images the pad surface of the belt and the temperature data is communicated to the processor 40. The sensor 41 shown is situated so that it can monitor the centerline of the belt as it travels linearly.

The particular infrared thermometer utilized is Model Thermalert GP manufactured by Raytek. It is appreciated that other sensors and temperature measurement techniques can be used as well. For example, thermocouples or RTD (Resistance Temperature Detector) elements could be used for the sensor 41. Also, the sensor 41 could be mounted to measure the underside of the belt as well, although the preference is to measure the pad surface which contacts the wafer.

The processor 40 receives the sensor 41 data, allowing the processor to continually monitor the belt temperature. The processor is also coupled to operate the valve 32 so that the steam flow to the manifold 28 can be controlled by the processor. Although not shown, the processor can also be configured to control the pressure of the boiler 30, as well as controlling the valve 34. A solenoid operated valve, as well as other devices, can be used for the valves shown.

One sequence of operation for performing CMP is as follows. The polisher is turned on and the belt 12 is engaged for initiation of a polishing cycle. Acquisition of the belt center line temperature begins with the sensor 41 sending data to the processor 40. The boiler is brought up to the desired operating temperature, if not already at the operating temperature. The valve 32 is opened to inject steam through the manifold 28 to heat the belt/pad assembly. The temperature of the belt 12 commences to increase and this increase is monitored by the sensor 41. Then when the belt centerline temperature reaches a desired operating point, the valve 32 is closed and the belt heating is disengaged. At this point, wafer processing commences on the polisher 10.

The selection of the operating temperature is defined by the user. In one technique, the selected operating point coincides with the equilibrium temperature of the polisher. Thus, the belt temperature is brought up to the equilibrium temperature by the steam. Then, the steam is disengaged. However, since wafer processing commences at the equilibrium temperature, the belt temperature will remain at this equilibrium temperature as wafers are processed. If, for some reason, the belt temperature drops below the equilibrium temperature, the steam can be engaged again to heat the belt 12.

Figure 4:
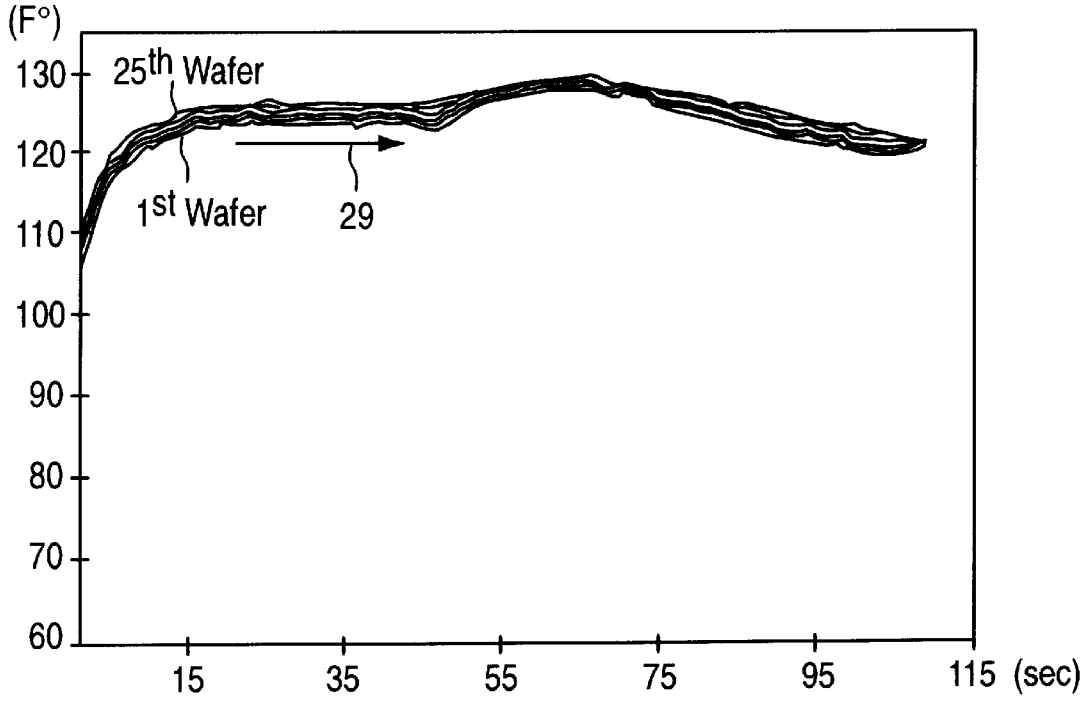
FIG. 4 is a graphical illustration of belt centerline temperature versus polishing time for sequencing through 25 wafer cycles, when the present invention is used to bring the belt to the operating temperature before the first wafer cycle commences.

In the embodiment described above, the belt and pad temperature is artificially brought up to the equilibrium temperature to stabilize the polishing process. The preheating of the belt in a controlled fashion allows the belt and the pad to stabilize to the operating temperature before any wafers are processed. Once the equilibrium temperature is reached, wafer processing can commence without a significant deviation in the temperature. As noted in FIG. 4, a more uniform and stabilized temperature profile is obtained as the wafers are cycled through the polisher, resulting in more uniform polishing characteristics. The temperature variation between the first wafer and the twenty-fifth wafer when utilizing the temperature compensating technique of the invention is shown in FIG. 4. Very little variation is noted between the first wafer and subsequent wafers. Furthermore, as noted by arrow 29, a flat polish temperature gradient is obtained.

Figure 5:
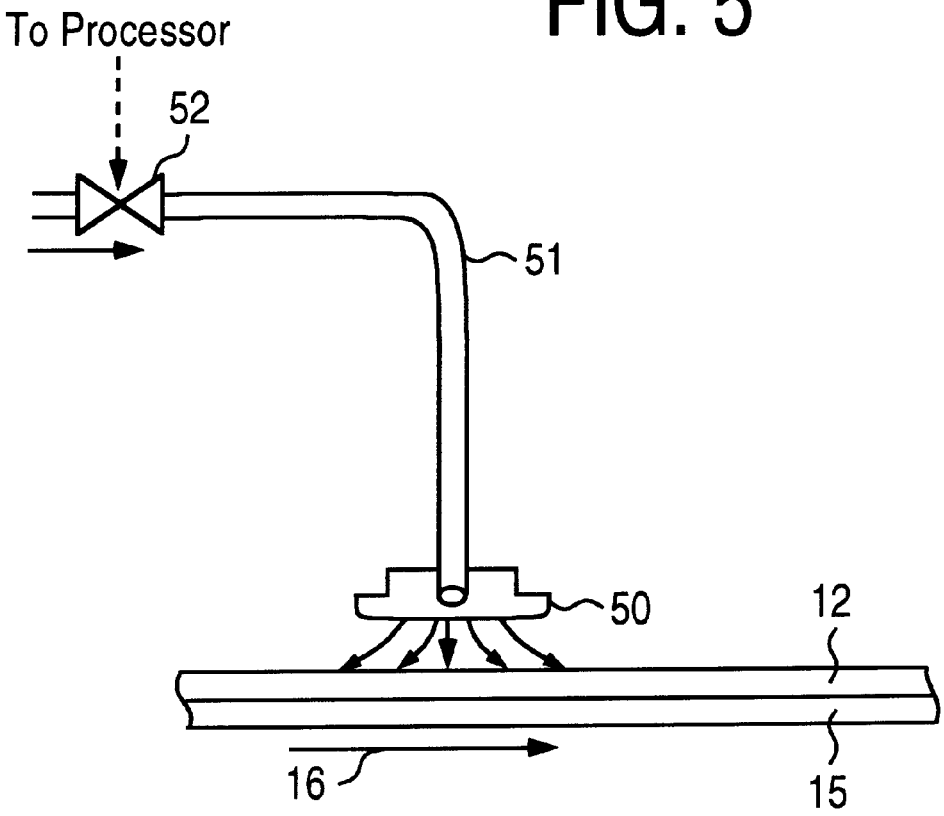
FIG. 5 is a cross-sectional drawing of the temperature compensating unit similar to that shown ion FIG. 2, but now cooling the belt to maintain a belt operating temperature below the ambient temperature.

In some instances, it may be desirable to set the operating temperature at some value other than the equilibrium temperature for the polisher. For example, a particular operating temperature of the belt may provide an optimum polishing characteristics for the process. In that event, the operating temperature can be controlled by the temperature compensating unit to maintain the belt temperature at a selected operating point. FIG. 5 illustrates an embodiment in which the belt is cooled to a temperature below ambient.

Referring to FIG. 5, a manifold 50 is shown having a fluid line 51 and a control valve 52. A cooling liquid or gas, such as cold water or cryogenic gas is introduced onto the belt 12 through the manifold 50 to cool (or super cool) the belt 12 to a temperature below the ambient temperature of the polishing tool. Line 50 is coupled to a source of the cooling fluid, which source may be located within the polishing tool or at some remote location. The valve 52 would be coupled to the processor 40 and controlled by the processor 40. The manifold 50 would operate equivalently to the manifold 28, but in this instance cooling fluid would be regulated to maintain the belt temperature at some point below ambient. Furthermore, although a manifold is shown, a series of nozzles distributed across the width of the belt will provide an equivalent result.

Figure 6:
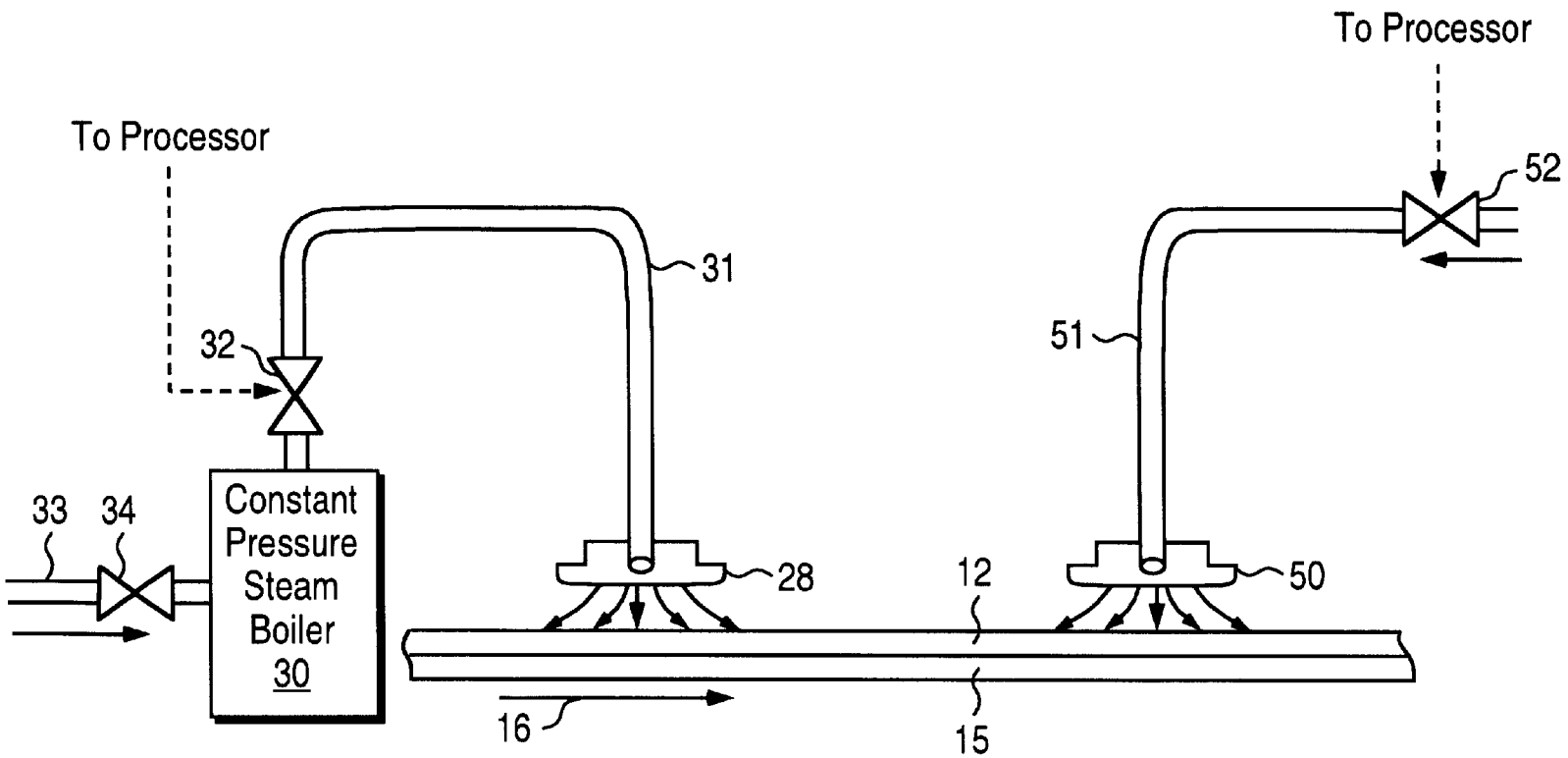
FIG. 6 is a cross-sectional drawing of an embodiment, in which the temperature compensating units, similar to that shown in FIGS. 3 and 5, are now both incorporated in the polisher to heat and cool the belt to maintain a belt operating temperature above ambient and below the equilibrium temperature.

Still another technique for belt temperature control is illustrated in an embodiment shown in FIG. 6. The temperature compensating unit of FIG. 6 employs both the heating device of FIG. 3 and the cooling device of FIG. 5. By utilizing the heating manifold 28 and cooling manifold 50, temperature regulation can be achieved in raising and lowering the temperature. For example, if the desired user defined operating temperature for the belt is some temperature above ambient, but below the equilibrium temperature of the polishing tool, the preheating technique described above can be used to rapidly bring the belt temperature to the desired operating point. Once wafer polishing commences, the temperature of the belt will begin to increase above the desired operating point in order to reach the equilibrium point. Once the rise in temperature above the desired point is sensed, the heating manifold is disengaged and the cooling manifold is engaged to start cooling the belt to maintain the belt temperature at the operating point.

Subsequently, the heating and the cooling of the belt can be performed as needed to maintain a fairly constant belt temperature as the wafers are cycled through the polisher. Thus, by the controlled application of belt heating and cooling, temperature stabilization, as shown in FIG. 4, can be achieved at a desired operating temperature, which may not be at the equilibrium temperature.

It is to be noted that the sensor 41 and the processor 40 are not shown in FIGS. 3 and 5, but would be utilized to provide the belt temperature sensing and regulation. Also, other means of heating and cooling can be used. For example, heat lamps and contact heating elements could be used. For cooling, water or super cool liquid can be sprayed. In most applications, it is desirable to heat or cool the underside of the belt across the whole width. Accordingly, the manifolds 28 and 50 shown in the Figures would extend across the width of the belt 12.

It is also appreciated that the heating and cooling units illustrated use an open system. That is, the steam or cooling fluid (water or nitrogen) are vented to the ambient surroundings. Alternatively, closed loop systems can be used in which the heating and/or cooling fluids are confined. Heat exchangers, radiators, refrigeration coils are some examples of closed loop systems. These closed loop systems can be adapted for the temperature compensating unit described above.

Thus, a method and apparatus for stabilizing the process temperature during CMP is described.

We claim:

1. An apparatus for controlling polishing temperature when polishing a planar surface comprising:

a belt disposed to move in a linear direction and having a pad material residing thereon for polishing the planar surface;

a sensor coupled to measure temperature of said belt;

a temperature compensating unit associated with said belt for adjusting the temperature of said belt to a selected operating temperature commensurate with an equilibrium operating temperature, the adjusting executed prior to polishing the planar surface.

2. The apparatus of claim 1 further including a processor coupled to said sensor and said temperature compensating unit for receiving temperature measurement data from said sensor and sending a control signal to said temperature compensating unit in response to the temperature measurement data to maintain the operating temperature.

3. The apparatus of claim 2 wherein said temperature compensating unit cools said belt to maintain said belt at the operating temperature.

4. The apparatus of claim 1 wherein said temperature compensating unit adds heat energy to said belt to raise the temperature of said belt to the operating temperature.

5. In a linear polisher for performing chemical-mechanical polishing (CMP) on a surface of a substrate or a surface of a layer formed on the substrate, an apparatus for controlling polishing temperature when polishing the surface comprising:

a belt disposed to move in a linear direction and having a pad material residing thereon for polishing the surface;

a sensor coupled to measure temperature of said belt;

a temperature compensating unit associated with said belt for adjusting the temperature of said belt to a selected operating temperature commensurate with an equilibrium operating temperature the adjusting executed prior to polishing the surface.

6. The apparatus of claim 5 further including a processor coupled to said sensor and said temperature compensating unit for receiving temperature measurement data from said sensor and sending a control signal to said temperature compensating unit in response to the temperature measurement data to maintain the operating temperature.

7. The apparatus of claim 6 wherein said temperature compensating unit adds heat energy to said belt to raise the temperature of said belt to the operating temperature.

8. The apparatus of claim 7 wherein steam is introduced onto said belt to increase the temperature of said belt to the operating temperature.

9. The apparatus of claim 6 wherein said temperature compensating unit cools said belt to maintain said belt at the operating temperature.

10. The apparatus of claim 9 wherein cold fluid is introduced onto said belt to cool said belt.

11. The apparatus of claim 6 wherein the operating temperature of said belt is equivalent to an equilibrium temperature of the polisher when polishing a plurality of substrates without utilizing said temperature compensating unit.

12. In a linear polisher for controlling polishing temperature when performing chemical-mechanical polishing (CMP) on a material layer formed on a semiconductor wafer comprising:

a belt disposed to move in a linear direction and having a pad material residing thereon for polishing the material layer;

a sensor coupled to measure temperature of said belt;

a temperature compensating unit associated with said belt for adjusting the temperature of said belt to a selected operating temperature commensurate with an equilibrium operating temperature, the adjusting executed prior to polishing the material layer.

13. The linear polisher of claim 12 further including a processor coupled to said sensor and said temperature compensating unit for receiving temperature measurement data from said sensor and sending a control signal to said temperature compensating unit in response to the temperature measurement data to maintain the operating temperature.

14. The linear polisher of claim 13 wherein said temperature compensating unit adds heat energy to said belt to raise the temperature of said belt to the operating temperature.

15. The linear polisher of claim 13 wherein said temperature compensating unit cools said belt to maintain said belt at the operating temperature.

16. The linear polisher of claim 13 wherein said temperature compensating unit adjusts the temperature of the belt by adding heat energy to raise the temperature of said belt to the operating temperature and also cooling said belt to maintain said belt at the operating temperature.

17. The linear polisher of claim 12 wherein the operating temperature of said belt is equivalent to an equilibrium temperature of the polisher when polishing a plurality of wafers without utilizing said temperature compensating unit.

18. A method of controlling polishing temperature for polishing a planar surface, the method comprising:

introducing heat energy to a linearly moving belt disposed to move in a linear direction and having a pad material residing thereon for polishing the surface;

measuring polishing temperature with a sensor coupled to measure temperature of said belt;

adjusting the temperature of the belt by preheating the belt prior to polishing in response to data measured by the sensor.

19. The method of claim 18 wherein said adjusting the belt temperature includes introducing heat energy to raise the belt temperature to a predetermined operating temperature.

20. The method of claim 19 wherein said introducing the heat energy includes injecting heated fluid onto the belt.

21. The method of claim 18 wherein said adjusting the belt temperature includes cooling the belt to maintain the belt temperature at a predetermined operating temperature.

22. The method of claim 21 wherein said cooling is provided by injecting cooling fluid onto the belt.

* * * * *